United States Patent [19]

Banicevic

[11] Patent Number: 4,791,854

[45] Date of Patent: Dec. 20, 1988

[54] HYDRAULIC PISTON AND CYLINDER ARRANGEMENT IN WHICH THE OUTER WALL OF THE PISTON ROD IS FREE FROM FLUID

[76] Inventor: Damir Banicevic, 124 Ruby Street, Winnipeg, Manitoba, Canada, R3G 2C9

[21] Appl. No.: 20,908

[22] Filed: Mar. 2, 1987

Related U.S. Application Data

[63] Continuation-in-part of Ser. No. 797,952, Nov. 14, 1985, abandoned.

[30] Foreign Application Priority Data

Nov. 14, 1984 [CA] Canada ..... 467846

[51] Int. Cl.[4] ..... F01B 25/26

[52] U.S. Cl. ..... 92/5 R; 92/52; 92/108; 92/151

[58] Field of Search ..... 92/108, 113, 117 A, 92/142, 52, 107, 151, 5 R

[56] References Cited

U.S. PATENT DOCUMENTS

| | | | |
|---|---|---|---|
| 3,726,184 | 4/1973 | Saits | 92/113 |
| 3,858,485 | 1/1975 | Rosaen | 92/108 |
| 4,202,514 | 5/1980 | Chen | 92/5 R |
| 4,207,565 | 6/1980 | Isakson | 92/5 R |
| 4,242,947 | 1/1981 | Renner | 92/108 |
| 4,409,884 | 10/1983 | Boehringer | 92/108 |
| 4,608,912 | 9/1986 | Navarette | 92/5 R |

FOREIGN PATENT DOCUMENTS

| | | | |
|---|---|---|---|
| 2153522 | 4/1973 | Fed. Rep. of Germany | 92/142 |
| 86210 | 7/1981 | Japan | 92/117 A |

*Primary Examiner*—Abraham Hershkovitz

*Attorney, Agent, or Firm*—Stanley G. Ade; Adrian D. Battison; Murray E. Thrift

[57] ABSTRACT

A hydraulic piston and cylinder arrangement retains the outer surface of a sleeve forming the piston in dry condition. The cylinder provides an outer wall and an inner stem with the sleeve sliding inwardly of the outer wall and outwardly of the stem. A head on the end of the stem cooperates with the inner surface of the sleeve. A bearing member on the end of the sleeve remote from the head cooperates with the outer surface of the stem. A first chamber is thus defined between the head and a closure cap on the sleeve to provide an expansion chamber. An annular chamber between the outer surface of the stem and the inner surface of the sleeve and closed by the bearing member provides a return chamber. Two fluid channels coaxially arranged within the stem provide the communication of fluid to the chambers.

11 Claims, 4 Drawing Sheets

HYDRAULIC PISTON AND CYLINDER ARRANGEMENT IN WHICH THE OUTER WALL OF THE PISTON ROD IS FREE FROM FLUID

This application constitutes a continuation-in-part application of my application, Ser. No. 797,952, filed Nov. 14, 1985, now abandoned.

BACKGROUND OF THE INVENTION

This invention relates to hydraulic piston and cylinder arrangements. Devices of this type are very well known and widely used in very many different applications. In many cases a simple arrangement including a single cylinder, a piston running within the cylinder and a piston rod is provided, with suitable seals at the piston and at the end of the cylinder through which the rod passes.

Such an arrangement is of course very simple but it suffers from major disadvantages in that the outer surface of the piston rod is continually wetted with the hydraulic fluid or oil. In the usual dusty or dirty environment where such cylinders operate, the dust and particles in the air can attach readily to the layer of oil on the outer surface of the piston rod and therefore collect on that surface and are transported into the cylinder on the rod. Furthermore the oil is separated from the environment only by the single seal between the end of the cylinder and the piston rod. While this seal when new and in good condition can effectively prevent the oil from escaping from the cylinder along the piston rod, as soon as it becomes contaminated with dust or other particles or in the case that it becomes damaged, the oil can immediately escape and will tend to run down the piston rod or back over the cylinder depending upon the orientation thus losing expensive fluid which must be replaced and in some cases causing dangerous and unsightly deposits of the fluid.

It is one object of the present invention, therefore, to provide an improved piston and cylinder arrangement in which the outer surface of the piston or piston rod is maintained free from the hydraulic fluid thus reducing the danger of contamination of the seals and also reducing the possibility of oil escape even in the event of damage of one of the seals.

SUMMARY OF THE INVENTION

According to a first aspect of the invention, therefore, there is provided a hydraulic piston and cylinder arrangement comprising a cylinder having an outer wall defining a bore therein, an end plug fixed to said outer wall at one end thereof, a stem fixed relative to said end plug and extending along the bore centrally thereto and providing a bearing surface externally of the stem and coaxial to said bore, a piston comprising a sleeve having an inner and outer surface such that the inner surface coaxially surrounds said bearing surface and is spaced therefrom by a first gap so as to define therewith a first annular chamber and such that the outer surface lies coaxially inwardly of said bore and is spaced therefrom by a second gap so as to define therewith a second annular chamber, an end closing member on said sleeve and a bearing member including a seal carried by and extending from said sleeve to cooperate with said bearing surface whereby to bridge said first gap and support the sleeve in axial sliding movement relative to said bearing surface, head means on an end of the stem remote from the end plug having a seal there around for cooperating with said inner surface to close said first chamber and to define with said end closing member a third chamber, closure means on an end of said outer wall remote from said end plug defining a seal there around for cooperating with said outer surface, said stem comprising a first tube having one end mounted in said end plug and carrying said head means on an opposed end thereof, a second tube mounted inside the first tube, the second tube extending from an outer surface of the end plug so as to define first channel means in said stem for communicating fluid to and from the end thereof remote from the end plug so as to communicate with said third chamber and second channel means defined in an annular space between said first tube and said second tube including an annular cavity in said end plug surrounding said second tube and closed by an end plate on said end plug, and including at least one radial hole in said first tube at said opposed end for communicating fluid to and from said first chamber at a position therein adjacent said head means whereby the application of fluid under pressure to said first channel means causes an expansion stroke of said piston relative to said cylinder and the application of fluid under pressure to said second channel means causes a retraction stroke of said piston relative to said cylinder, said bearing member including an annular recess surrounding the stem in a surface thereof closing said first annular chamber, said first and second channel means, said end plug, said bearing member and said stem being arranged such that said second annular chamber is free from fluid whereby said outer surface of said piston sleeve remains free from said fluid.

The arrangement thus provides a second chamber externally of the sleeve forming the piston rod which is normally free from fluid and therefore prevents the collection of fluid on the outer surface of the sleeve. Should at any time fluid escape into the second chamber due to failure of a seal then this can be observed and action taken to replace the seal before quantities of fluids start to escape from the device.

The specific construction of the stems, end cap and bearing member provides a device which is simple to manufacture and effective in operation.

This basic construction can be modified to a number of different designs as described hereinafter.

It is also an important feature of the invention that the cylinder and end plug can be formed from a tube and separate end plug piece fixed into the tube with the ports being attached to the end plug leaving the cylinder undistorted.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
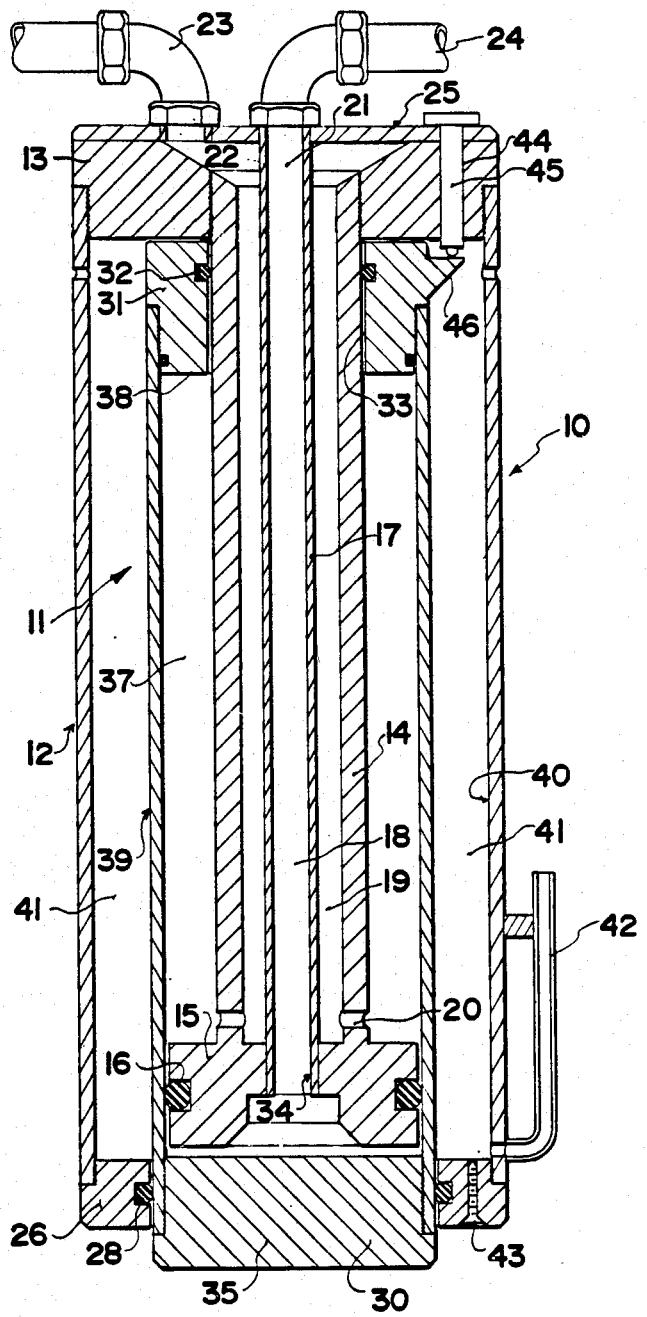
FIG. 1 is a cross sectional view of a first embodiment of hydraulic piston and cylinder arrangement.

Turning firstly to the embodiment illustrated in FIG. 1, this comprises a cylinder generally indicated at 10 and a piston and piston rod generally indicated at 11. The cylinder comprises an outer cylindrical wall 12 which is closed at one end by an end plug 13 separate from and fixed to the cylindrical wall 12 by any suitable means for example a screw thread or a compression coupling. The end plug 13 carries a stem 14 which is arranged inwardly of the outer wall 12 and coaxial thereto and is defined by a cylindrical wall in turn secured to the end plug 13 by any suitable means. At the end of the stem 14 remote from the end plug 13 is mounted a head 15 which is rigidly attached to the cylindrical wall of the stem 14 for example by a screw thread coupling and extends outwardly to a greater diameter than the stem 14 thus providing a cylindrical body on the end of the stem 14 carrying a sealing ring 16 on the outer peripheral surface thereof.

The stem 14 includes a inner cylindrical duct or tube 17 inside the wall 14 and coaxial therewith so as to define a first channel 18 inside the duct 17 and a second channel 19 outside the duct 17, the latter being annular and confined by the inner surface of the wall 14. A pair of ports 20 communicate with the annular channel 19 and pass through the wall 14 adjacent the head 15 so as to communicate fluid inside the channel 19 to the exterior of the stem 14.

At the end of the stem adjacent the end plug 13, the first channel 18 passes directly through an end plate 25 at the end plug 13 in the form of an axially aligned channel 21. The annular channel 19 also passes directly through the end plug in the form of an annular channel 22 this communicating with a port 23 on the end plate 25 of the end plug 13 with the first channel communicating with a second port 24 on the end face or end plate indicated at 25 of the end plug.

The outer wall 12 of the cylinder supports an end closure means indicated at 26 which is annular in form so as to define an inner bore 27 supporting a sealing ring 28.

The piston 11 is in the form of a sleeve 29 which is closed at the end remote from the end plug 13 by an end closing member 30 which totally closes the end of the sleeve so as to form a closed bore within the sleeve 29. The end adjacent the end plug 13 carries a bearing member 31 which is attached to the sleeve 29 by suitable means for example a screw thread and carries a sealing ring 32 on an inner surface thereof so as to cooperate with an outer surface of the stem 14. The bearing member 31 thus provides an inner cylindrical surface 33 on which the seal 32 is carried which is coaxial to the outer surface of the stem 14.

In operation fluid is supplied under pressure to the port 24 and communicates through the central channel 18 and through a bore 34 in the head 15 to a chamber 35 between the head 15 and the end closing member 30. This applies pressure to the end closing member 30 to move the sleeve forming the piston in an expansion stroke downwardly as shown in FIG. 1.

Fluid contained within a chamber 37 defined between an inner surface of the sleeve 29 and the outer surface of the stem 14 is expelled by movement of the bearing member 31 downwardly with the sleeve 29 under pressure from a surface 38 of the bearing member 31. The fluid expelled from the chamber 37 passes through the ports 20 into the channel 19 for expulsion from the port 23. An annular recess 381 in the end surface 38 allows the surface to engage head 15 while the holes 20 are received in the recess 381 and thus are prevented from being closed.

In a retraction stroke of the piston, fluid under pressure is applied to the port 23 and thus passes through the port 20 which are held open by the recess 381 so as to cause pressure against the surface 38 to withdraw the bearing member 31 and thus the sleeve 29. At the same time fluid is expelled from the chamber 35 through the channel 18.

It will be appreciated that the radial dimension of the closure means 26 defines a gap between an outer surface 39 of the sleeve 29 and an inner surface 40 of the outer wall 12. The seal 27 of the closure means 26 runs against the outer surface 39 of the sleeve 29 and thus a chamber defined between those surfaces is completely closed. Fluid within the chamber 37 is prevented from entering the outer chamber indicated at 41 by the seal 32 and while the outer surface of the stem 14 is wetted by the fluid, this is insufficient to allow substantial amounts of fluid to collect within the annular chamber 41. Thus the outer surface 39 of the sleeve 29 and the bore 40 remains free from fluid and the surface 39 is dry when exposed from the end of the cylinder thus avoiding the collection of dust on the outer surface.

It will be noted that the chamber bounded by the end plug 13, the bore 40, the outer wall 39, the closure member 31 is not supplied with fluid.

If due to the failure of the seal 32, fluid should pass into the outer annular chamber 41, this will collect at the bottom of the chamber and can be observed by a sight-glass 42 mounted externally of the outer wall 12. Any such fluid collecting can be allowed to escape by opening a plug 43 so as to maintain the chamber 41 free from fluid and the outer surface 39 dry. Should the amount of fluid collecting be excessive, this is of course indicative of a failure thus requiring the device to be repaired by replacement generally of the seal 32.

A bore 44 through the end plug 13 carries a switch 45 which can cooperate with a flange 46 on the bearing member 31 so as to indicate the completion of a retraction stroke. This avoids fluid continuing to be applied to the chamber 37 when the piston has completed the retraction stroke and thus avoids excessive pressure against the seal 32 which could otherwise allow the escape of fluid into the outer chamber 41.

Figure 2:
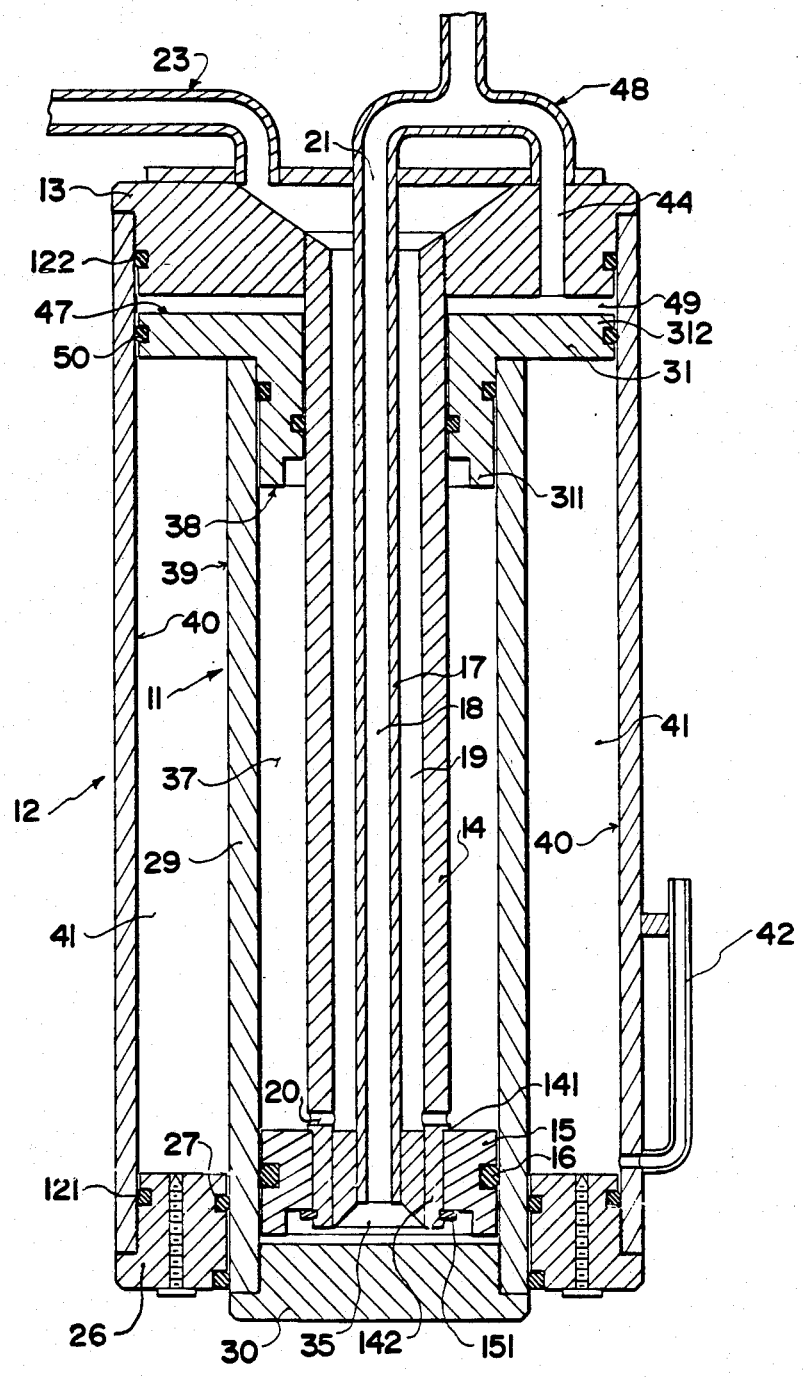
FIG. 2 is a similar cross sectional view through a second embodiment.

Turning now to FIG. 2, there is shown a modified embodiment. A number of the modifications are of a minor nature concerning the construction of the head 15 which in this embodiment comprises an annular portion which slides onto a reduced section of the stem 14 to engage a shoulder 141. A retaining ring 151 mounts on the end of the reduced portion 142 of the stem so as to retain the head in position. Furthermore the closure means 26 and the end plug 13 are connected to the outer wall 12 by way of seals 121 and 122 as opposed to the screw thread coupling of FIG. 1.

According to a major modification of FIG. 1, the bearing member 31 is divided into an inner bearing portion 311 and an outer bearing portion 312. The former carries out the previously described purpose of cooperating with the outer surface of the stem 14 to define therewith the chamber 37 which acts to produced the retraction stroke of the piston. The outer bearing portion 312 cooperates with the inner surface 40 of the outer wall 12 so as to separate the chamber 41 from a further chamber 46 which communicates with the bore 44 through the end plug 13. The chamber 45 thus, in this embodiment, can be used to apply pressure to the piston by way of an upper surface 47 of the bearing member 31 so that fluid under pressure supplied through the port 44 acts to provide an expansion stroke of the piston relative to the cylinder. The chamber 46 can be used in conjunction with the chamber 35 to provide a large power stroke in comparison with the return stroke in view of the larger surface areas provided by the surface 47 of the bearing member 31 and the upper surface of the end closing member 30. Alternatively the chamber 35 and the chamber 46 can be used as alternates. In a further arrangement, the port indicated at 48 connected to the bore 44 can be removed and the switch 45 as shown in FIG. 1 used in the bore 44.

In any event it will be noted that the inner surface 40 of the outer wall 12 is spaced from the outer surface 39 of the sleeve 29 so that while the inner surface 40 of the outer wall is wetted by fluid in the chamber 46, this wetted surface is retained spaced from the outer surface of the sleeve and thus this outer surface remains dry. Should the seal indicated at 50 of the outer bearing portion 312 fail then fluid will collect in the outer chamber 41 but this will be observed by the sight-glass 42. In normal functioning of the device the outer surface 39 is retained dry and thus avoids contamination as previously explained.

Figure 3:
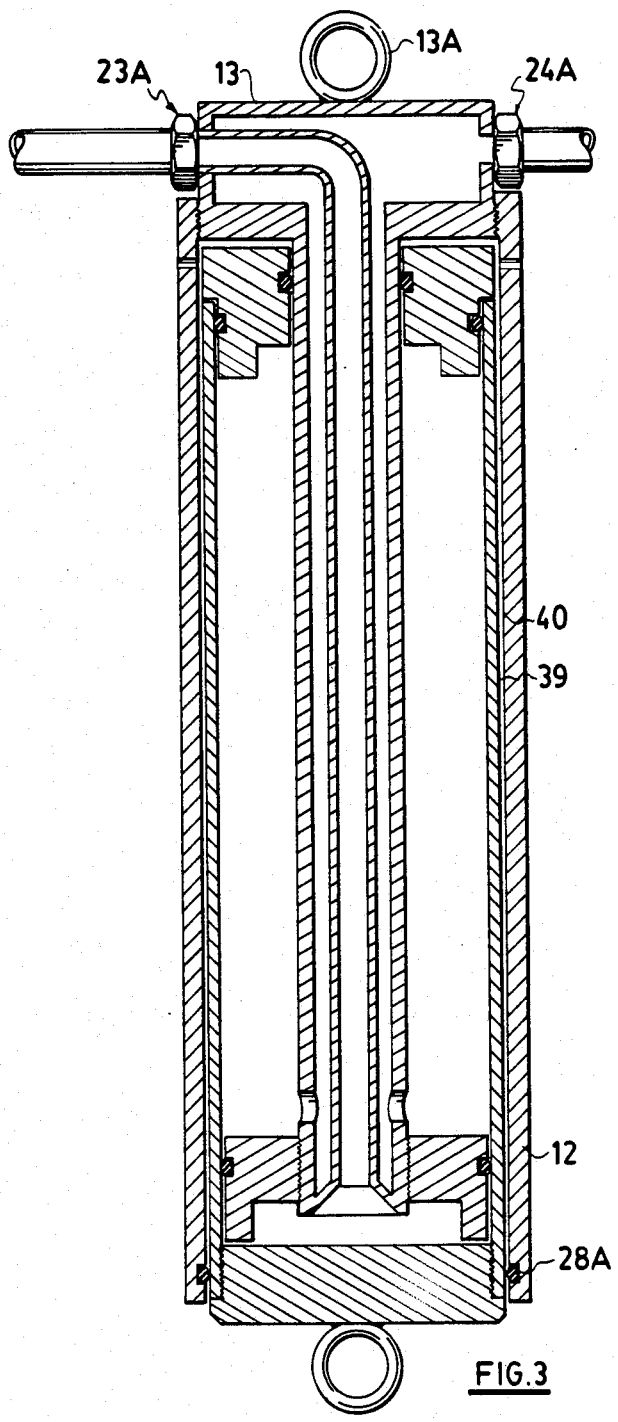
FIG. 3 is a similar cross sectional view through a third embodiment.

Referring now to FIG. 3, this embodiment is substantially the same as the embodiment of FIG. 1 except for two modifications.

In the first modification, the ports in the end cap 13 are arranged in the radial or peripheral surface of the end cap 13 as indicated at 23A and 24A respectively. This provides an area on the end face of the end cap 13 for an attachment ring 13A by which the cylinder can be attached to suitable actuation mechanism.

In the second modification, the closure member 26 is omitted and replaced by a sealing ring 28A attached directly to the inner surface of the cylinder 12. This leaves a small annular clearance of the order of 1/16th inch between the outer surface 39 of the sleeve and the inner surface 40 of the cylinder. As in the embodiment of FIG. 1, the area beneath the end cap and above the bearing member is free from fluid and therefore no fluid gets on the inner surface 40 or the outer surface 39 with the latter remaining dry as it passes out past the seal 28A.

Figure 4:
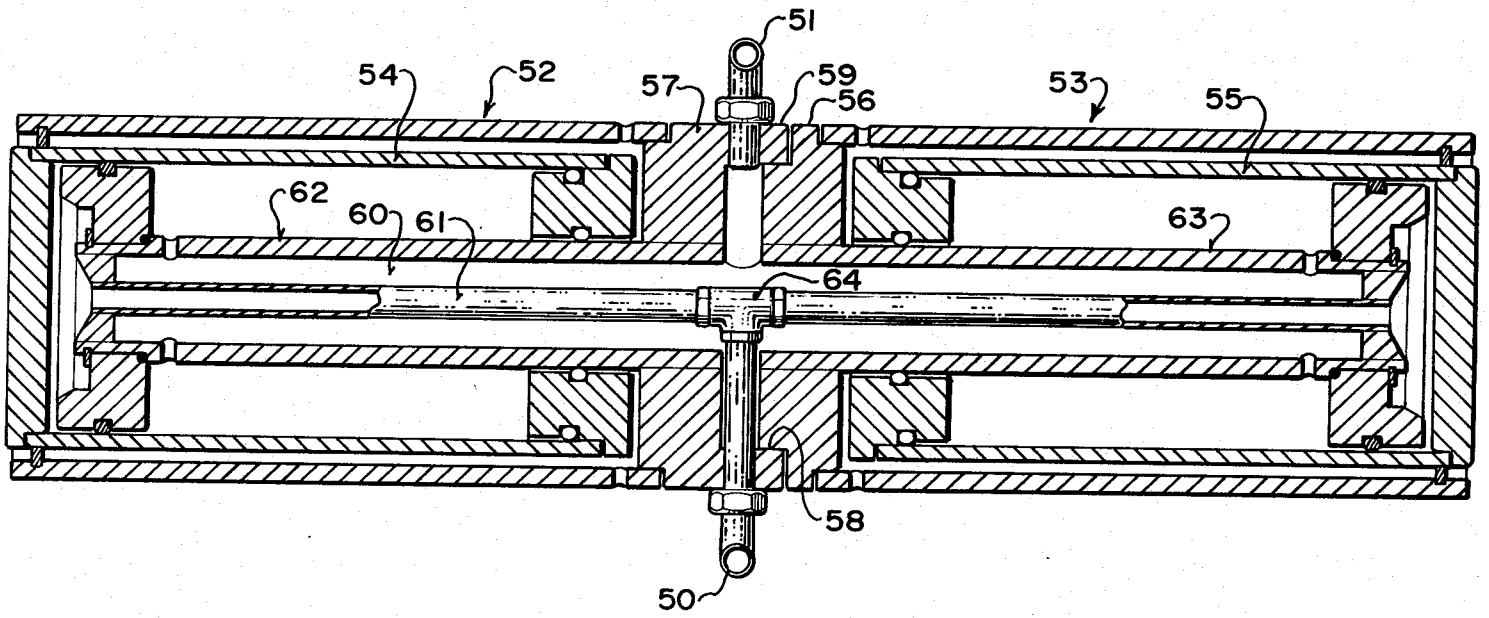
FIG. 4 shows two cylinders of the type shown in FIG. 3 arranged back to back.

Turning now to FIG. 4, this shows a construction of cylinder in which two pistons can move in opposed directions outwardly from a central position under control of fluid supplied at ports 50 and 51 respectively. Each of the cylinders generally indicated at 52 and 53 respectively is of the construction shown basically in FIG. 3 and includes a piston 54, 55.

The back to back arrangement enables an end plug 56 of the cylinder 53 to act as the end plate for the end plug 57 of the cylinder 52 and vice versa. In the arrangement shown the end plug 56 is cut down at a reduced portion 58 which carries a screw thread for cooperation with an internal screw thread of a flange portion 59 of the end plug 57.

The port 51 communicates through the space between the end plugs 56 and 57 to the annular area 60 defined between an inner tube 61 and two outer tubes 62 and 63. The inner tube 61 extends continuously along the two separate outer tubes 62 and 63 so as to form a common tube for both of the cylinders 52 and 53. A T coupling 64 connects the tube 61 to the port 50. The cylinders operate as previously described so that supply of fluid to the port 50 causes the pistons 54 and 55 to be expelled from the cylinders with fluid returning from the port 51. Similarly supply of fluid at the port 51 retracts both of the pistons 54 and 55 into the respective cylinder.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A hydraulic piston and cylinder arrangement comprising a cylinder having an outer wall defining a bore therein, an end plug fixed to said outer wall at one end thereof, a stem fixed relative to said end plug and extending along the bore centrally thereto and providing a bearing surface externally of the stem and coaxial to said bore, a piston comprising a sleeve having an inner and outer surface such that the inner surface coaxially surrounds said bearing surface and is spaced therefrom by a first gap so as to define therewith a first annular chamber and such that the outer surface lies coaxially inwardly of said bore and is spaced thereform by a second gap so as to define therewith a second annular chamber, an end closing member on said sleeve and a bearing member including a seal carried by and extending from said sleeve to cooperate with said bearing surface whereby to bridge said first gap and support the sleeve in axial sliding movement relative to said bearing surface, head means on an end of the stem remote from the end plug having a seal there around for cooperating with said inner surface to close said first chamber and to define with said end closing member a third chamber, closure means on an end of said outer wall remote from said end plug defining a seal there around for cooperating with said outer surface, said stem comprising a first tube having one end mounted in said end plug and carrying said head means on an opposed end thereof, a second tube mounted inside the first tube, the second tube extending from an outer surface of the end plug so as to define first channel means in said stem for communicating fluid to and from the end thereof remote from the end plug so as to communicate fluid only to said third chamber and second channel means defined in an annular space between said first tube and said second tube including an annular cavity in said end plug surrounding said second tube and closed by an end plate on said end plug, and including at least one radial hole in said first tube at said opposed end for communicating fluid only to and from said first chamber at a position therein adjacent said head means whereby the application of fluid under pressure to said first channel means causes an expansion stroke of said piston relative to said cylinder and the application of fluid under pressure to said second channel means causes a retraction stroke of said piston relative to said cylinder, said bearing member having an inner cylindrical surface surrounding and closely adjacent the bearing surface of the stem and an annular recess surrounding the stem in an end surface of the bearing member closing said first annular chamber, said annular recess defining a recess cylindrical surface at a position of increased radial spacing from said stem than said inner cylindrical surface and a base surface spaced axially of said end surface of the bearing member, said first and second channel means, said end plug, said bearing member and said stem being arranged such that said second annular chamber is free from fliud whereby said outer surface of said piston sleeve remains free from said fluid.

2. The invention according to claim 1 including means for observing any fluid entering said second annular chamber.

3. The invention according to claim 2 wherein said observing means comprises a sight-glass.

4. The invention according to claim 1 including a switch for indicating completion of the retraction stroke.

5. The invention according to claim 1 wherein the end plug comprises a separate part welded into the cylinder and wherein the first and second channels extend through said end plug and communicate with the end of the stem mounted in the end plug.

6. The invention according to claim 1 including a second bearing member including a seal carried by and extending from the sleeve to cooperate with said bore whereby to bridge said second gap and define with said end plug a fourth chamber separated from said second chamber by said second bearing member and third channel means for communicating to and from said fourth chamber whereby the application of fluid under pressure to said fourth chamber causes an expansion stroke of said piston relative to said cylinder while said second bearing member retains said second chamber and therefore said outer surface of the sleeve free from said fluid.

7. The invention according to claim 6 wherein the third channel passes through the end plug separate from said first and second channels.

8. The invention according to claim 6 wherein the first and second bearing members are integral and attached to said sleeve at the end thereof remote from said end closing member.

9. The invention according to claim 6 wherein the third channel passes axially through the end plug whereby it can receive a switch for indicating completion of a retraction stroke.

10. The invention according to claim 1 including a second cylinder and a second piston arranged coaxially, symmetrically and back to back to said cylinder and said piston with the end plug of said second cylinder forming said end cap for said cylinder, said first channel means of said cylinder being connected to said first channel means of said second cylinder and said second channel means of said cylinder being connected to said second channel of said second cylinder.

11. The invention according to claim 10 wherein said second tube comprises a common tube extending from said head means of said cylinder to said head means of said second cylinder.

* * * * *